US006719019B2

(12) United States Patent
Cao et al.

(10) Patent No.: US 6,719,019 B2
(45) Date of Patent: Apr. 13, 2004

(54) DEPLOYABLE OXYGEN CHARGING SYSTEM

(75) Inventors: Tuan Q. Cao, Davenport, IA (US); Steven D. Jinks, Rock Island, IL (US)

(73) Assignee: Litton Systems, Inc., Los Angeles, CA (US)

( * ) Notice: Subject to any disclaimer, the term of this patent is extended or adjusted under 35 U.S.C. 154(b) by 0 days.

(21) Appl. No.: 10/183,442

(22) Filed: Jun. 28, 2002

(65) Prior Publication Data

US 2004/0000351 A1 Jan. 1, 2004

(51) Int. Cl.[7] ..... B65B 1/04

(52) U.S. Cl. ..... 141/100; 141/37; 141/54; 137/565.29

(58) Field of Search ..... 137/565.29, 565.3, 137/565.33; 141/2, 18, 9, 100, 104, 37, 44, 51, 54, 55, 56, 197, 192, 198, 94

(56) References Cited

U.S. PATENT DOCUMENTS 3,948,281 A * 4/1976 Strain et al. ..... 137/3
4,860,803 A * 8/1989 Wells ..... 141/9
5,495,875 A * 3/1996 Benning et al. ..... 141/83
6,079,459 A * 6/2000 Klotz et al. ..... 141/18

* cited by examiner

*Primary Examiner*—Steven O. Douglas
(74) *Attorney, Agent, or Firm*—Lowe Hauptman Gilman & Berner, LLP

(57) ABSTRACT

A gas cylinder charging system includes (1) at least two gas inlet ports and (2) at least two gas outlet ports, (3) a gas compressor having an input port and an output port, where the input port selectively receives gas from a gas inlet port and selectively transfers the gas to a gas outlet port, and (4) a controller, receiving status signals and transmitting control signals, and connected to and controlling the gas compressor. A method aspect of filling a gas cylinder using the described cylinder charging system further including an input/output selector valve for selecting one of the gasses to transfer to the gas cylinder, includes the following steps. A gas cylinder is connected to one of the cylinder connectors. A user manipulates the selector valve selecting the gas to be transferred to the gas cylinder and activates the cylinder charging system filling the gas cylinder with the selected gas.

10 Claims, 6 Drawing Sheets

DEPLOYABLE OXYGEN CHARGING SYSTEM

FIELD OF THE INVENTION

The present invention relates generally to a gas cylinder filling system and a method of using same, and more particularly, to a gas cylinder filling system having at least two inlet ports and at least two outlet ports. Still more particularly, the present invention relates to a gas cylinder filling system able to transfer both oxygen and medical grade air from gas sources to gas cylinders.

BACKGROUND OF THE INVENTION

Ventilators or anesthesia machines use gas cylinders typically filled with oxygen or medical grade air. Frequently, such machines are used in military forward surgical suites or hospitals. With specific reference to the military context, it is important that the necessity of transporting filled gas cylinders to the battlefield is reduced to reduce the number of supply trips required. Gas cylinder charging systems are used to refill empty gas cylinders from the output of gas sources. The filled gas cylinders may then be used as either a primary or backup gas supply source.

Prior art cylinder charging systems provide the ability to fill gas cylinders, a process frequently referred to as charging the cylinders, with either one of oxygen i.e., 93% oxygen, or medical grade air, but not both. This is due to the different standards, as set by the Compressed Gas Association (CGA), for each gas type including different valve, gas line, and connection specifications. For example, inlet connector fittings for a gas cylinder charging system to receive gas from a gas source are specified using a Diameter Index Safety System (DISS), such as CGA Standard 1240 for 93% oxygen and CGA Standard 1160 for medical grade air. The outlet connector fittings for the gas cylinders are specified as CGA Standard 870 for 93% oxygen filled gas cylinders and CGA Standard 950 for medical grade air filled gas cylinders. These standards specify fitting sizes which are incompatible with each other, thereby preventing improper cross-connection of fittings.

The DISS provides dimensions and other data used to produce or use medical designed fittings for various gas connections used in hospital and patient care applications. The specified fittings are gas-specific and noninterchangeable. The use of specific fittings for specific gas types avoids cross-connection of medical gas supplies to gas cylinders. Because of the different gas-specific specifications, at a minimum, two cylinder charging systems have been required to fill two gas cylinders, one for oxygen and one for medical grade air. There is a need in the art for a single gas cylinder charging system capable of filling gas cylinders with two or more different gas types from a corresponding gas type supply.

SUMMARY OF THE INVENTION

It is therefore an object of the present invention to provide a method and apparatus for filling gas cylinders of two or more different gas types from a corresponding gas type supply.

In an apparatus aspect, a gas cylinder charging system includes at least two gas inlet ports and at least two gas outlet ports. A gas compressor having an input port and an output port, where the input port receives gas from one of the gas inlet ports and transfers the gas to one of the gas outlet ports, is included. A controller, receiving status signals and transmitting control signals, is also included and is connected to and controls the gas compressor.

A method aspect of filling a gas cylinder using a cylinder charging system having gas inlet ports connected to a source of different gasses, gas outlet ports connected to cylinder connectors, and an input/output selector valve for selecting one of the different gasses to place in the gas cylinder, includes the following steps. A gas cylinder is connected to one of the cylinder connectors. The selector valve is manipulated to select the gas to be placed in the gas cylinder and the cylinder charging system is activated filling the gas cylinder with the selected gas.

A system aspect of a gas generation and gas cylinder filling system includes a gas source supplying at least two different gasses, at least two fill whip connectors, and a gas cylinder charging system coupling one of the gasses supplied from the gas source to one of the fill whip connectors.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description thereof are to be regarded as illustrative in nature, and not as restrictive.

BRIEF DESCRIPTION OF THE DRAWINGS

The present invention is illustrated by way of example, and not by limitation, in the figures of the accompanying drawings, wherein elements having the same reference numeral designations represent like elements throughout and wherein.

DETAILED DESCRIPTION OF THE DRAWINGS

A gas cylinder charging system is used to charge different gas cylinders with different gas types. The charging system receives gas from a gas source, e.g. oxygen and medical grade air from an oxygen generating system, and compress and transfers the gas to a gas cylinder. One such source is a mobile oxygen concentrator (MOC) and another is a patient ventilator oxygen concentration system (PVOCS) such as the system described in U.S. Pat. No. 6,394,089 entitled "Patient Ventilator Oxygen Concentrating System," and which is incorporated herein by reference in its entirety.

Figure 1:
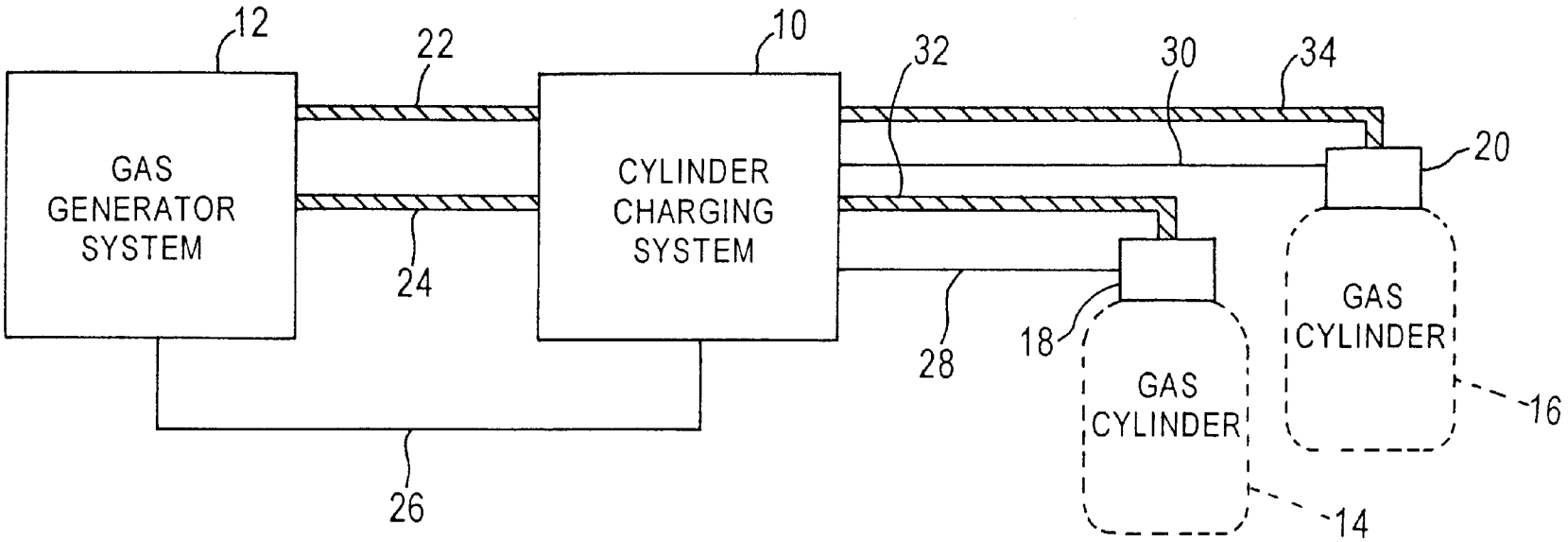
FIG. 1 is a high level block diagram of a preferred embodiment of the present invention.
Figure 4:
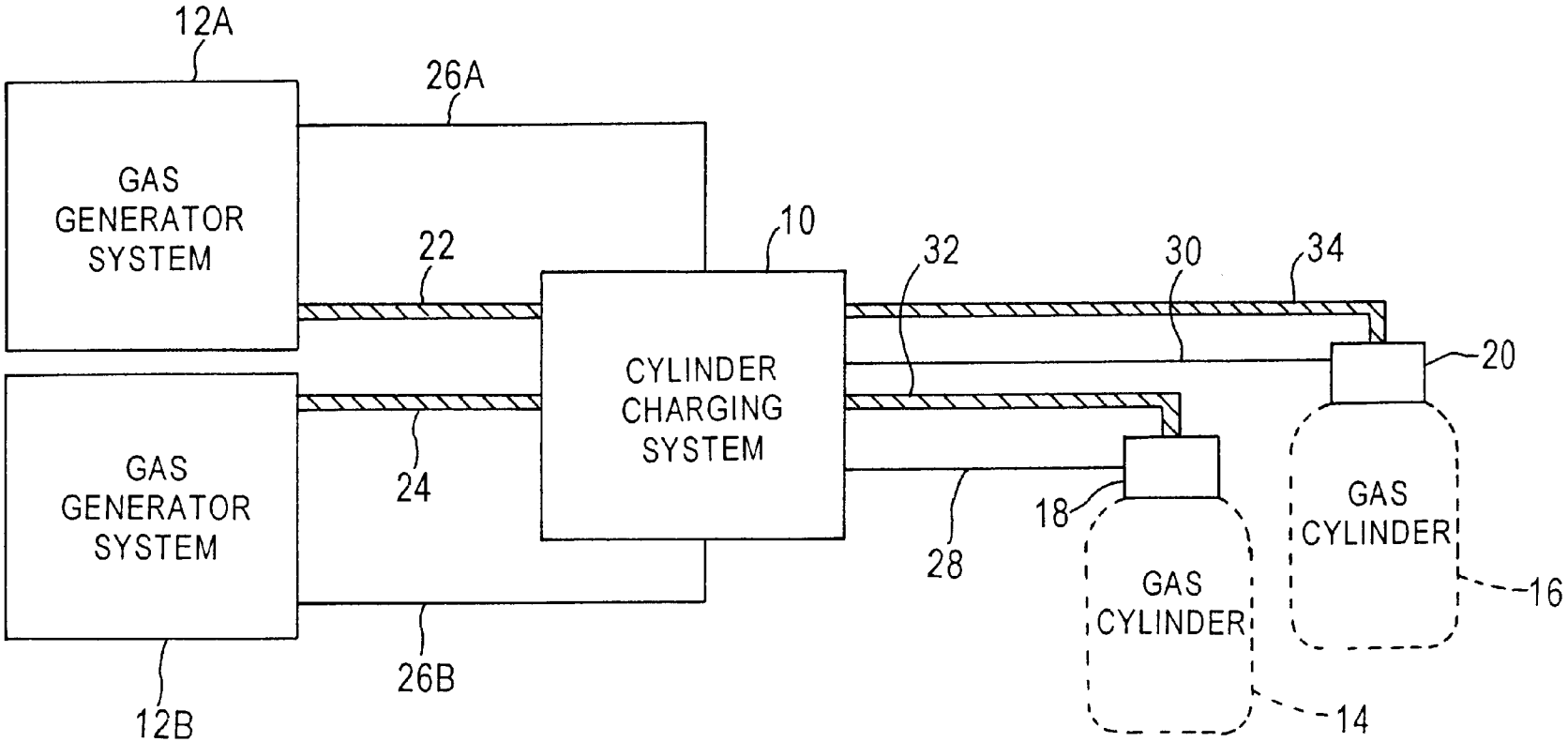
FIG. 4 is a high level block diagram of an alternate embodiment of the present invention.

FIG. 1 is a high level block diagram of a cylinder charging system 10 in use according to an embodiment of the present invention. The cylinder charging system 10 receives gas from a gas generator system 12 and directs the received gas to one of gas cylinders 14 and 16 via fill whips 18 and 20, respectively. Fill whips are gas cylinder connectors for providing a gas to a gas cylinder. Different gas types require different fill whips to prevent accidental filling of a gas type in the wrong gas cylinder. Each gas cylinder has a connection adapted to connect to a particular type of fill whip, pursuant to one of the specific CGA Standards described above. Depending on the number of gas types desired to be handled by charging system 10, there may be more than two fill whips in a particular embodiment. Gas generator system 12 directs the flow of gas to cylinder charging system 10 by gas lines 22 and 24. A mobile oxygen concentrator (MOC), i.e., an oxygen generating system, and a PVOCS, i.e. an oxygen and medical grade air generating system, are two examples of gas generator system 12. Gas generator system 12 may be either one or both of the MOC or PVOCS or another gas type generating system. Because the MOC generates a single gas type, it may be necessary to use a PVOCS or other additional gas generator system in an arrangement as shown in FIG. 4 and described below. In an alternate embodiment, cylinder charging system 10 determines, based on status signals received from gas generator system 12, that only a single gas type is available and disables filling a gas cylinder with a gas from a non-existent gas source (i.e., gas generator system) by not enabling a compressor 52 (described below) internal to the cylinder charging system 10.

Gas generator system 12 and cylinder charging system 10 are also connected by signal line 26 for transmission of status signals. Gas generator system 12 typically is able to provide a gas at a pressure between 20 and 50 pounds per square inch (psi) to each one of gas lines 22 and 24.

After detecting the connection of a gas cylinder to a fill whip, the fill whip (18 or 20) to which the cylinder is connected supplies a signal along signal lines 28 and 30 to cylinder charging system 10 indicating the presence of a gas cylinder (14 or 16), as appropriate. After receiving the cylinder presence signal, cylinder charging system 10 directs the flow of a gas received from gas generator system 12 to one of the gas cylinders 14 or 16 via gas line 32 or 34, respectively, as appropriate depending on whether a cylinder is connected to the gas line as determined by the cylinder presence signal. Cylinder charging system 10 compresses the gas in the gas cylinders to a pressure of up to 2,000 psi via gas lines 32 and 34. Because charging system 10 is able to determine the presence of a gas cylinder at a fill whip 18 or 20, it is not necessary that both gas cylinders 14 and 16 be connected at the same time to the respective fill whips 18 and 20.

For example, if gas generator system 12 produces two different gas types, e.g., gas types A and B, gas line 22 conducts gas type A to cylinder charging system 10 and gas line 24 conducts gas type B to cylinder charging system 10. Correspondingly, gas line 32 conducts gas type A and gas line 34 conducts gas type B from charging system 10 to an appropriate gas cylinder, i.e., gas line 32 directs gas type A to gas cylinder 14 which is of a type to receive gas type A and gas line 34 directs gas type B in a similar manner to gas cylinder 16 which is adapted to receive gas type B.

Cylinder Charging System

Cylinder charging system 12 is now described with reference to FIG. 2. Briefly, an input/output (I/O) selector valve 50 receives gas from either one of gas lines 22 and 24 depending on the position of the selector valve 50. I/O selector valve 50 then directs the gas to a compressor 52 controlled by a controller 54, receives the gas at an increased pressure from compressor 52, and provides the compressed, i.e., higher pressure, gas to the appropriate one of gas lines 32 and 34 as determined by the position of the selector valve 50.

Figure 3:
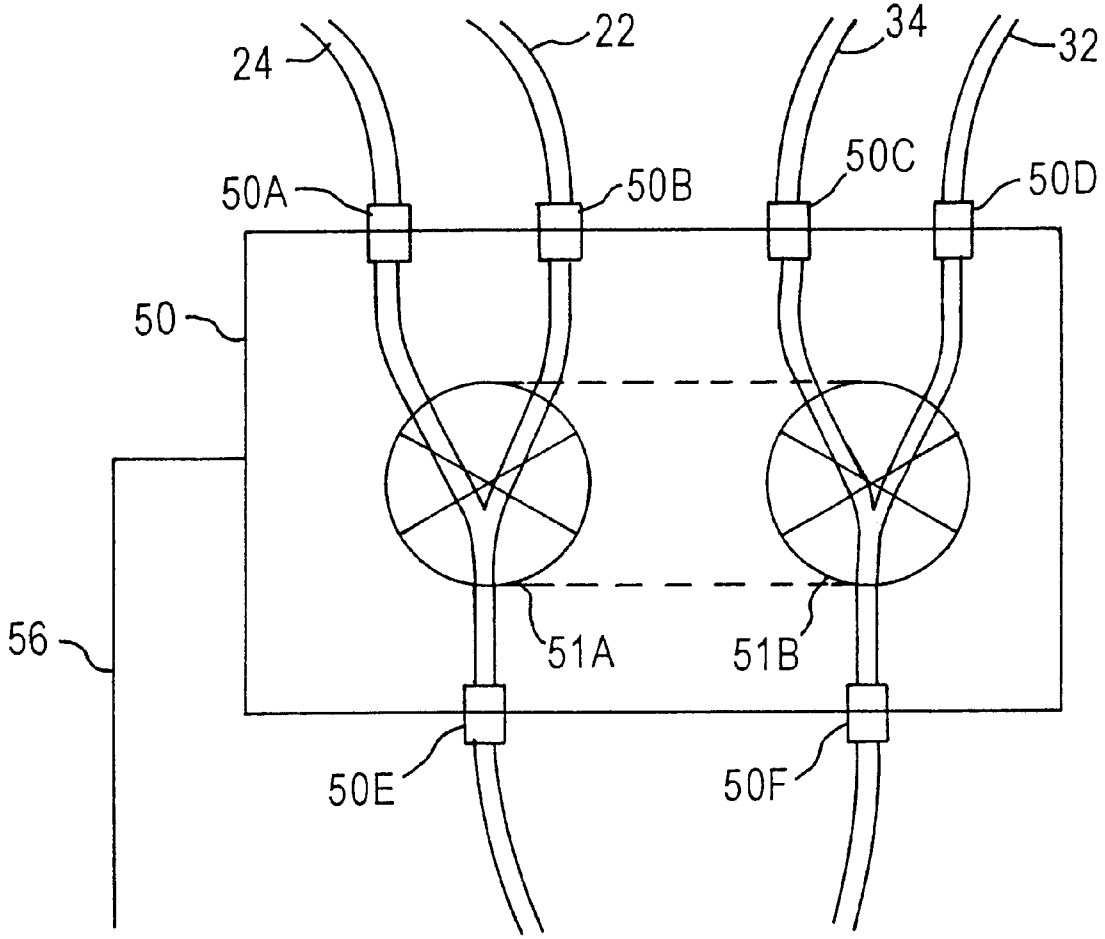
FIG. 3 is a high level block diagram of a selector valve of the cylinder charging system of FIG. 2.

Selector valve 50 includes six ports 50A, 50B, 50C, 50D, 50E, and 5OF for receiving and transmitting gas as shown in FIG. 3. Two linked valves 51A and 51B are used to direct gas between ports 50A, 50B, and port 50E, and at the same time to direct gas between ports 50C, 50D, and port 50F. For example, if valve 51A of the selector valve 50 is positioned such that gas from port 50A flows to port 50E, then correspondingly valve 51B will be positioned to allow the flow of gas between port 5OF and 50C. The selector valve 50 position is transmitted to controller 54 via a valve position signal line 56.

An example of selector valve 50 in operation is now described with reference to FIG. 6 in which a portion of charging system 10, specifically selector valve 50, is shown in connection with the gas cylinders 14 and 16. For this example, a gas source (not shown), e.g. a gas generator system 12 such as a PVOCS, supplies two different gas types A and B to charging system 10. Gas type A flows through gas line 24 to port 50A of selector valve 50. Gas type B flows through gas line 22 to port 50B of selector valve 50.

On the right hand side of the drawing, a gas cylinder 14 for receiving gas type B is connected to fill whip 18 which is specifically adapted to connect to type B gas cylinders. A gas connect to type A gas cylinders. In response to detecting the connection of gas cylinder 14, fill whip 18 transmits a cylinder presence signal to charging system 10 along signal line 28. Similarly, fill whip 20 transmits a cylinder presence signal to charging system 10 along signal line 30 in response to detecting the connection of gas cylinder 16. Fill whip 20 is connected to port 50C of selector valve 50 via gas line 34 to receive type A gas from charging system 10. Fill whip 18 is connected to port 50D of selector valve 50 by gas line 32 to receive type B gas from charging system 10.

Depending upon the position of valve 51A, one of either gas type A or B is directed to port 50E of selector valve 50, then to compressor 52 (not shown) and returns to port 50F of selector valve 50. Depending upon the position of valve 51B, the gas flow received at port 5OF is directed to one of either port 50C or 50D.

The operation of an exemplary selector valve setting and corresponding flow of gas is now described. As depicted in FIG. 6, valve 51A is positioned to allow the flow of gas between port 50A and 50E, i.e. enabling the flow of gas type A through the selector valve 50. Also, because valve 51A is linked with valve 51B, valve 51B is positioned to allow the flow of gas between port 50F and 50C, i.e. enabling the flow of gas type A through the selector valve 50 and to type A gas cylinder 16.

Figure 6:
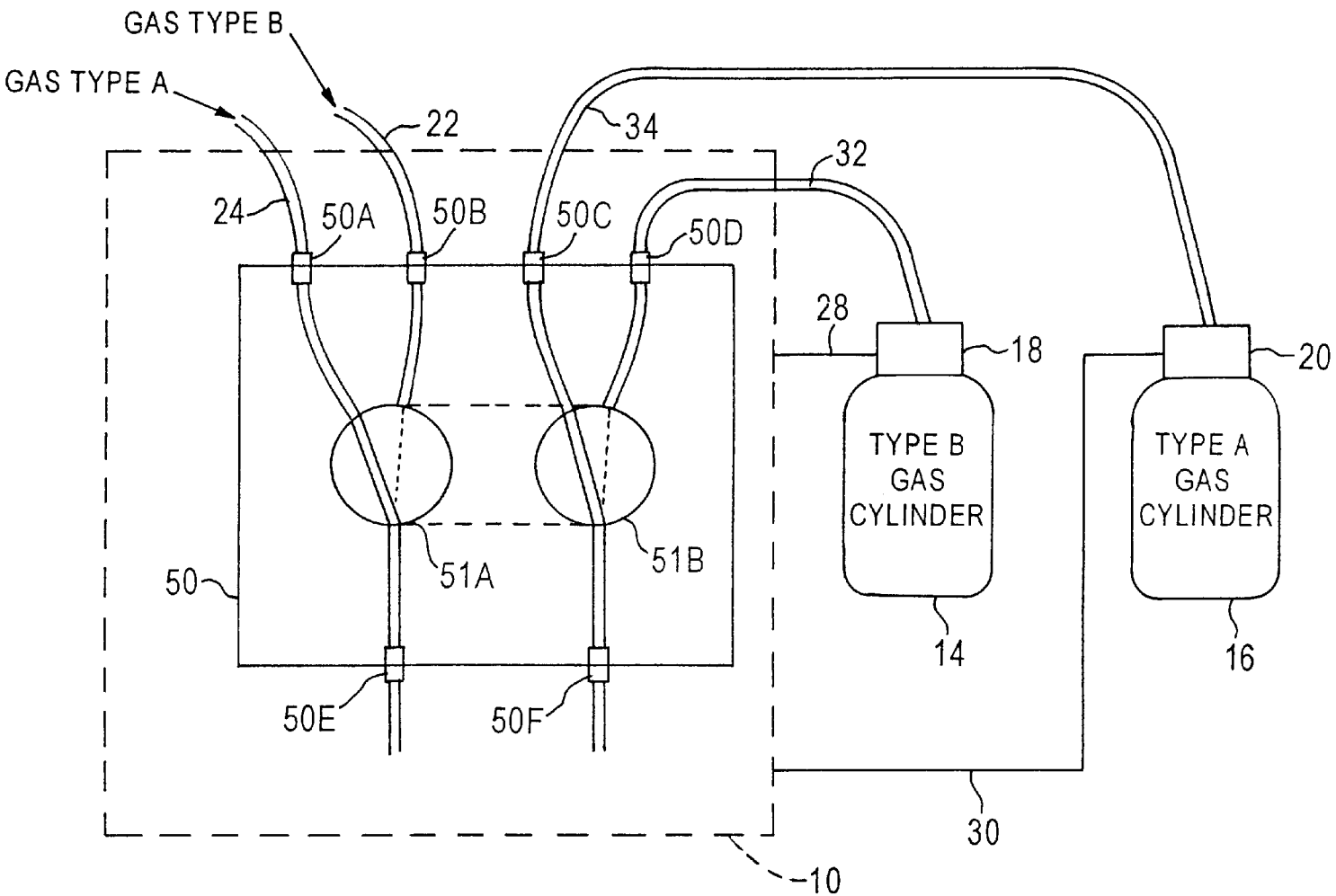
FIG. 6 is a high level block diagram of a portion of the cylinder charging system of FIG. 1 in use.

After gas cylinder 16 is filled with gas type A, if a user desires to fill gas cylinder 14 with gas type B, the user manipulates selector valve 50 changing the position of linked valves 51A and 51B to the dotted lines shown in FIG. 6. With valves 51A and 51B in this position, gas type B is able to flow through gas line 22 and port 50B through valve 51A and port 50E to compressor 52 (not shown). Gas type B is then directed through port 50F and valve 51B to port 50D, through gas line 32 and fill whip 18 to gas cylinder 14.

Thus, the flow of a particular gas through the system based on the position of selector valve 50 has now been described.

With respect to the above described preferred embodiment of FIG. 1, gas lines 22 and 24 from gas generator system 12 respectively, are connected to ports 50B and 50A of selector valve 50 and gas lines 32 and 34 to gas cylinders 14 and 16 respectively, are connected to ports 50D and 50C of the selector valve 50. Port 50E is connected to the gas line connecting the selector valve 50 to a pressure regulator 58 and port 50F is connected to the gas line connecting the selector valve to a high pressure check valve 64 in parallel with a fill whip venting valve 70.

The pressure regulator 58 connects the gas line output from I/O selector valve 50 to a compressor inlet venting valve 60. Pressure regulator 58 reduces the pressure of gas received from gas generator system 12 to between 20–25 psi. Inlet venting valve 60 automatically vents the input gas line of compressor 52 to a low pressure protection check valve 62 to enable easier starting of compressor 52.

Compressor 52 compresses the received gas and directs the gas to a high-pressure check valve 64. Compressor 52 includes a pressure sensor (not shown) for detecting and reporting whether the pressure at the gas line output of compressor 52 has reached a preset pressure setting. The preset pressure setting is set by a user and is set to 2,000 psi in the preferred embodiment. Thus, if the pressure at the gas line output of compressor 52 meets or exceeds the preset pressure setting, as detected by the pressure sensor, compressor 52 transmits a signal via pressure signal line 65 to controller 54 indicating that the preset pressure setting has been met. That is, the gas cylinder 14, 16 selected by connector valve 50 and connected to charging system 10 is full. A pressure reducing regulator 66 in series with a compressor head venting valve 68 is also connected to the gas line output of compressor 52 to automatically vent the output gas line of compressor 52 and thereby enable easier starting of compressor 52.

High-pressure check valve 64 is connected in parallel to fill whip venting valve 70 and port 50F of the I/O selector valve 50. Fill whip venting valve 70 is manually operated by a user to vent either gas line 32 or 34, depending on the selector valve 50 position, and thereby enable easier removal of cylinders 14 and 16 by reducing the pressure at the fill whip connection. I/O selector valve 50 then allows the selected gas to flow to the appropriate cylinder 14 or 16 by gas line 32 or 34, depending on the position of the selector valve.

A user activates a fill switch 72 to cause the charging system 12, and more particularly compressor 52, to compress gas received from the gas generator system 12 and transfer the compressed gas to a gas cylinder 14, 16. An enable relay 74 is activated by controller 54 (described in detail below) to enable power from a power source (not shown) to drive compressor 52. The enable relay 74 also controls compressor head venting valve 68 (connection not shown) and, indirectly through control of compressor 52, inlet venting valve 60 (connection not shown). Fill switch 72 controls the execution of compressor 52 subject to enable relay 74 being enabled by controller 54. That is, a user activating fill switch 72 will cause compressor 52 to run only if enable relay 74 has been enabled by controller 54.

Controller

Figure 2:
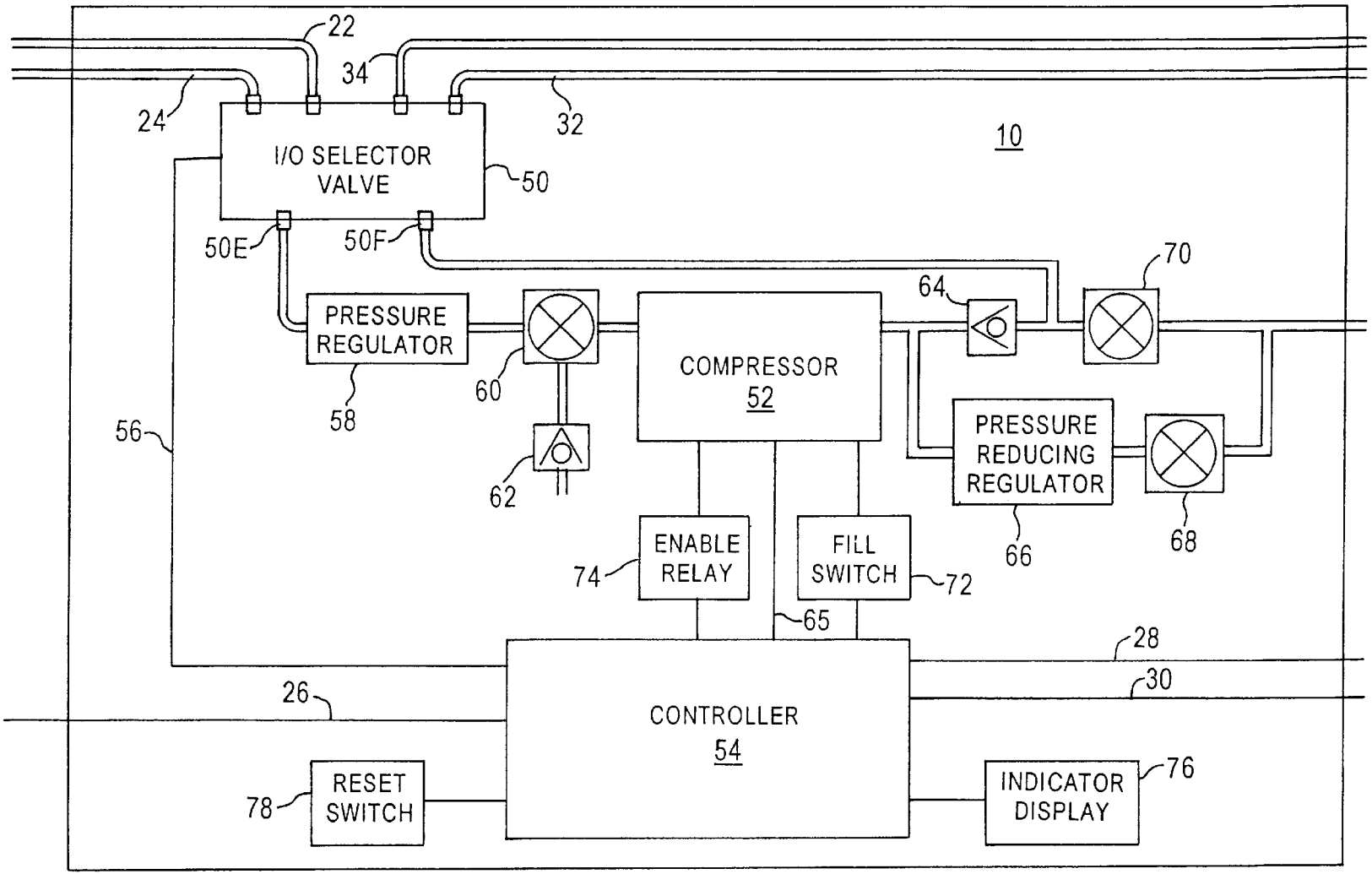
FIG. 2 is a high level block diagram of a cylinder charging system of FIG. 1.

As shown in FIG. 2, cylinder charging system 12 includes a controller 54 for controlling operation of the cylinder charging system. Controller 54 is a microprocessor-based device executing sequences of instructions stored in memory (not shown) that cause the controller 54 to receive status and control signals and to transmit control signals to control filling a gas cylinder 14, 16 with gas.

Controller 54 receives status signals from selector valve 50, fill whip connectors 18, 20, and gas generator system 12. Controller 54 receives a position indicating signal from selector valve 50 over signal line 56 indicating the position of the valve, i.e., the specific gas type selected to be transferred to a gas cylinder. A cylinder present signal is received by controller 54 from either or both of fill whip connectors 18, 20 indicating the presence of a gas cylinder 14, 16, as appropriate, i.e., the specific gas cylinder type connected depending on which fill whip connector transmitted the cylinder present signal. Controller 54 receives status signals from gas generator system 12 via signal line 26. Status signals received from generator system 12 include oxygen and carbon monoxide levels, dew point, oxygen pressure status, medical air pressure status, and PVOCS status or MOC status, as appropriate. Because either a PVOCS or MOC system may be connected to the cylinder charging system 12, the status signals received over signal line 26 may differ based on the type of gas generator system connected. Further, it is to be understood that in an alternate embodiment different gas types and gas generators may be employed requiring different or additional signals.

Controller 54 receives an additional status signal from compressor 52 via pressure signal line 65 indicating that the gas cylinder has reached the preset pressure value.

In an alternate embodiment shown in FIG. 4, there are two gas generator systems 12A, 12B connected to cylinder charging system 10. In this embodiment, there are two signal lines 26A, 26B connecting the gas generator systems 12A, 12B to the cylinder charging system 10. Gas lines 22 and 24 are respectively connected to the gas generator systems 12A, 12B.

Figure 5:
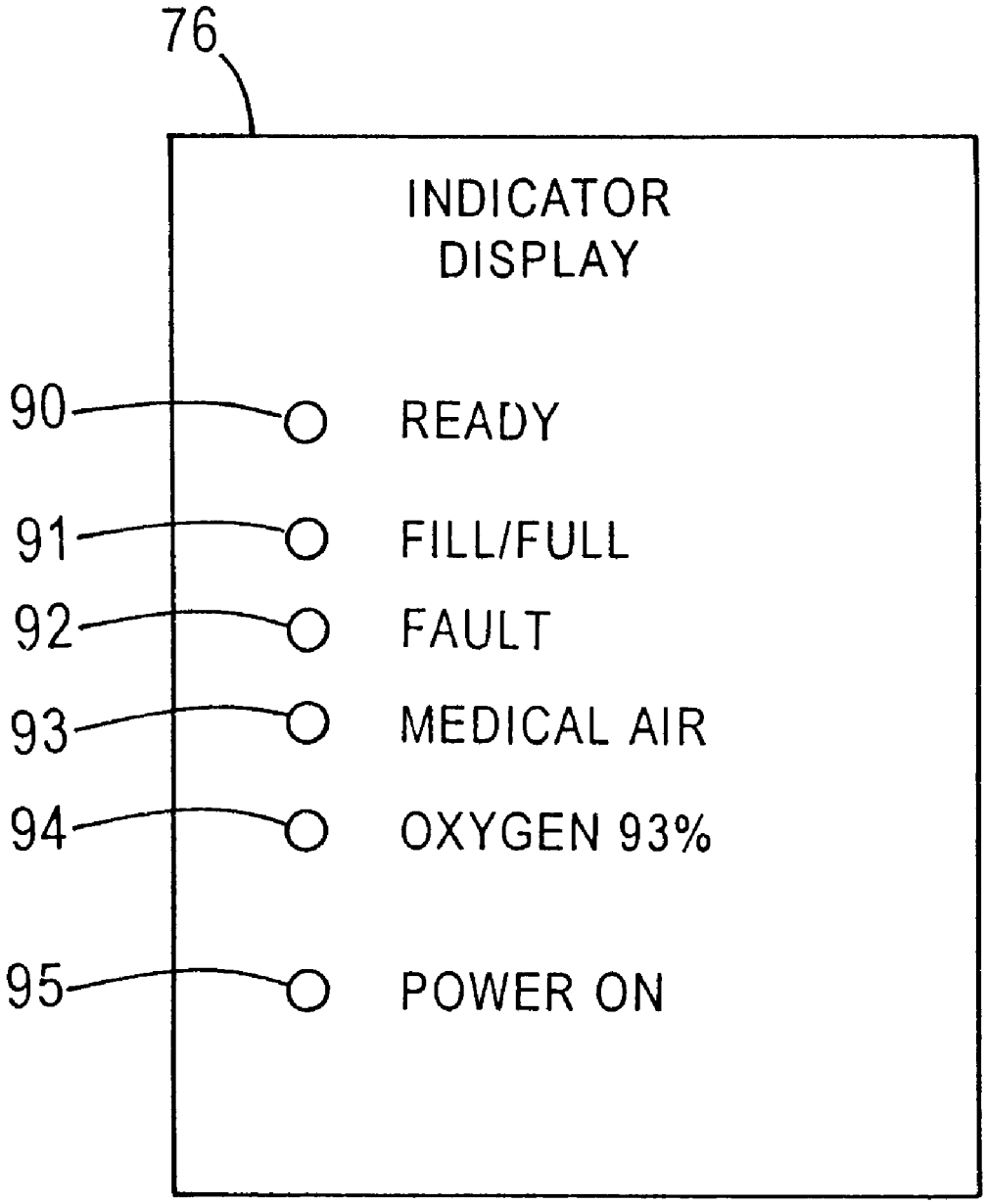
FIG. 5 is a diagram of an indicator display of the cylinder charging system of FIG. 2.

Controller 54 transmits a signal to an indicator display 76 to indicate status information to a user. Indicator display 76 is shown in FIG. 5 and includes a ready indicator 90 indicating that the correct gas generator system 12, i.e., MOC or PVOCS as indicated by status signals received via signal line 26, is connected to charging system 10 and is ready to transfer gas to a gas cylinder 14, 16. Indicator display 76 further includes a fill/full indicator 91 indicating that the system is filling a gas cylinder (indicator 91 flashes) and that a gas cylinder 14, 16 is full (indicator 91 solid on). A fault indicator 92 on indicator display 76 is activated by controller 54 if a fault occurs, e.g., improper operation of compressor 52 or based on status information received from gas generator system 12. If a gas cylinder 14, 16 connected to a fill whip connector 18, 20 matches the selected gas type, as indicated by the position of selector valve 50, either a medical air indicator 93 or an oxygen indicator 94 is activated. If controller 54 is on, a power indicator 95 is activated by controller 54.

Controller 54 receives a reset control signal from a reset switch 78 activated by a user to reset the controller. Reset switch 78 is used to cause controller 54 to clear fault conditions, i.e. cause controller 54 to turn off fault indicator 92 on indicator display 76, determined by the controller 54 and clear the fill/full indicator 91 on indicator display 76 after the user removes a full gas cylinder 14 or 16 from the fill whip connector 18, 20.

Operation of Cylinder Charging System

At the start of a gas cylinder charging cycle, a user desiring to fill an empty gas cylinder 14 with medical grade air connects the gas cylinder to a fill whip connector 18. In this example, it is assumed that fill whip connector 18 is a medical grade air connector. After connection of gas cylinder 14 to fill whip connector 18, the connector 18 sends a cylinder detection signal to cylinder charging system 10, and more specifically to controller 54, indicating the connection of the gas type cylinder to the connector. Controller 54 determines the status of gas generator system 12, i.e., determines whether the selected gas (medical grade air) and pressure are provided by the gas generator system 12 by checking either stored status information from memory or receiving status information from status line 26, and determines the position of selector valve 50 by checking either stored position information in memory or receiving position information from the selector valve via signal line 56.

If gas generator system 12 is providing the selected gas (medical grade air) at a proper pressure and selector valve 50 is positioned to direct medical grade air to the gas cylinder 14, controller 54 transmits a signal to indicator display 76 causing ready indicator 90 and medical air indicator 93 to be turned on. Controller 54 transmits a signal enabling enable relay 74 causing compressor 52 to receive power and thereby causing compressor inlet venting valve 60 to complete a gas flow path between pressure regulator 58 and compressor 52. Enable relay 74 also causes compressor head venting valve 68 to close directing future gas flow from compressor 52 to pass through high pressure check valve 64.

The user, viewing the turn on of indicators 90 and 93 at indicator display 76, manipulates the fill switch 72 to activate the charging system 10. Compressor 52 receives the fill switch 72 activation signal and begins compressing gas received from gas generator system 12 via selector valve 50, pressure regulator 58, and compressor inlet venting valve 60. The compressed gas then flows through high pressure check valve 64, through selector valve 50, along gas line 32 to fill whip connector 18, and finally to gas cylinder 14.

Compressor 52 continues providing gas to gas cylinder 14, as described above, until the preset pressure sensor setting has been reached or exceeded as indicated by a signal received over pressure signal line 65. After receiving the pressure setting reached signal from compressor 52, controller 52 transmits a signal to indicator display 76 to turn on fill/full indicator 91 and disables the enable relay 74 causing the compressor to turn off and compressor inlet venting valve 60 and compressor head venting valve 68 to open to atmosphere and thereby vent the compressor to ambient pressure.

The user, viewing the turn on of fill/full indicator 91 at indicator display 76, manipulates fill whip venting valve 70 to vent the fill whip connector 18 and gas line 32 to ambient pressure enabling release of gas cylinder 14 from the fill whip connector. The user then manipulates the reset switch 78 causing the controller to reset the indicators on indicator display 76. Controller 54 receiving the reset signal from reset switch 78 disables enable relay 74, causing the venting of compressor 52 to ambient pressure if not already performed normally, and resets indicators 90–95 on indicator display 76 and transmits a signal to cause the indicators to display the current status of charging system 10.

If a fault occurs, as described above, controller 54 transmits a signal to turn on fault indicator 92 on indicator display 76.

It will be readily seen by one of ordinary skill in the art that the present invention fulfills all of the objects set forth above. After reading the foregoing specification, one of ordinary skill will be able to affect various changes, substitutions of equivalents and various other aspects of the invention as broadly disclosed herein. It is therefore intended that the protection granted hereon be limited only by the definition contained in the appended claims and equivalents thereof.

What is claimed is:

1. A gas cylinder charging system, comprising:

at least two gas inlet ports;

at least two gas outlet ports, wherein at least two of the gas outlet ports each include a connector adapted to connect to a different gas cylinder from the other connector;

a gas compressor having an input port and an output port, wherein said input port receives gas from at most one gas inlet port and transfers gas to at most one gas outlet port;

a controller having an interface adapted to receive status signals and transmit control signals, the controller connected to the gas compressor and adapted to control the gas compressor.

2. The gas cylinder charging system as claimed in claim 1, further comprising:

a selector valve connected between the at least two gas inlet ports, the at least two gas outlet ports, and the gas compressor and adapted to (A) receive a gas from one of the two gas inlet ports and transfer the received gas to the gas compressor and (B) receive gas from the gas compressor and transfer the received gas to one of the two gas outlet ports; and the controller connected to the selector valve and adapted to receive status signals from the selector valve.

3. The gas cylinder charging system as claimed in claim 2, wherein the selector valve includes a single position setting mechanism to determine the flow of gas through the selector valve.

4. The gas cylinder charging system as claimed in claim 2, further comprising: a pressure regulator and a compressor inlet venting valve series connected between the selector valve and the compressor input port.

5. The gas cylinder charging system as claimed in claim 2, further comprising:

a high pressure check valve connected between the selector valve and the compressor output port; and a series connected pressure reducing regulator and a compressor head venting valve connected in parallel with the high pressure check valve.

6. The gas cylinder charging system as claimed in claim 2, further comprising:

an indicator display.

7. The gas cylinder charging system as claimed in claim 6, wherein the indicator display includes at least one of a ready indicator, a fill/full indicator, a fault indicator, and a power indicator.

8. The gas cylinder charging system as claimed in claim 2, further comprising:

at least two fill whip connectors each for receiving a gas cylinder and each connected to one of the gas outlet ports of the selector valve.

9. The gas cylinder charging system as claimed in claim 8, wherein each fill whip connector is connected to the controller and transmits a signal indicative of a gas cylinder presence to the controller after detecting connection of a gas cylinder and wherein the controller is adapted to receive a gas cylinder presence signal from each fill whip connector.

10. The gas cylinder charging system as claimed in claim 1, wherein the gas is at least one of medical grade air and oxygen.

* * * * *